United States Patent [19]

Kuhlthau, Jr.

[11] Patent Number: 5,029,606

[45] Date of Patent: Jul. 9, 1991

[54] WALL-MOUNTED HOOK-UP ASSEMBLIES FOR WASHING MACHINE AND LAVATORY

[76] Inventor: Paul W. Kuhlthau, Jr., 4519 Thornleigh Dr., Indianapolis, Ind. 46226

[21] Appl. No.: 445,999

[22] Filed: Dec. 5, 1989

[51] Int. Cl.[5] ..... E03C 1/042; E03C 1/184

[52] U.S. Cl. ..... 137/360; 4/192; 4/195; 4/211

[58] Field of Search ..... 4/192, 195, 211; 137/360; 285/64

[56] References Cited

U.S. PATENT DOCUMENTS

| | | | |
|---|---|---|---|
| 2,832,080 | 4/1958 | Hertenstein et al. . | |
| 2,952,271 | 9/1960 | Dick et al. . | |
| 3,234,958 | 2/1966 | Butters | 137/360 |
| 3,381,700 | 5/1968 | Frymark . | |
| 3,638,678 | 2/1972 | Symmons | 137/595 |
| 3,823,737 | 7/1974 | Szymanski | 137/360 X |
| 3,867,957 | 2/1975 | Fehrm | 137/360 |
| 3,868,968 | 3/1975 | Fuhrmann . | |
| 4,069,837 | 1/1978 | Jirasek . | |
| 4,133,312 | 1/1979 | Burd . | |
| 4,158,471 | 6/1979 | Logsdon . | |
| 4,162,546 | 7/1979 | Shortell | 4/211 X |
| 4,410,004 | 10/1983 | Kifer et al. . | |
| 4,637,422 | 1/1987 | Izzi | 137/360 |
| 4,716,925 | 1/1988 | Prather | 137/360 |
| 4,846,207 | 7/1989 | Humpert et al. | 137/360 X |

FOREIGN PATENT DOCUMENTS

| | | | |
|---|---|---|---|
| 2396912 | 2/1979 | France | 137/360 |

OTHER PUBLICATIONS

"Webstone Washing Machine Shut-Off", by Webstone Company, Inc., appearing in *Supply House Times*, Mar. or Apr. 1989.

*Primary Examiner*—Gerald A. Michalsky

[57] ABSTRACT

An in-the-wall base unit is provided for connection of building water supply and drain lines to it. A surface-mounted adaptor unit is fastened to the front of the base unit, extends outside the wall for connection of the supply and drain lines in the one instance to a washing machine, and in the other example, to a lavatory. A cover plate neatly frames the adaptor unit and covers the relatively small opening in the wall board through which it extends. A single lever valve assembly controls both the hot and cold water. Build-in drain and vent provisions are made.

13 Claims, 8 Drawing Sheets

WALL-MOUNTED HOOK-UP ASSEMBLIES FOR WASHING MACHINE AND LAVATORY

BACKGROUND OF THE INVENTION

This invention relates generally to plumbing installations, and more particularly to a wall-mounted unit which can supply hot and cold water to a washing machine or lavatory, as well as provide a means of carrying the waste water from the same units to a drain line.

DESCRIPTION OF THE PRIOR ART

For many years, the typical practice to provide for washing machine connections in residential construction, has been to provide a metal box recessed in a wall and having hose bibs in it for hot and cold water, each of them having a valve on it. There is a drain outlet in the bottom of the box. The washing machine drain hose fits into a small bracket in the box immediately above the drain to discharge waste water into the drain outlet. After a period of time, and particularly if the hose bibs or hoses leak somewhat, or there is splash from the waste discharge hose, the boxes become dirty and rusty. If the box is made of plastic, they may still become dirty. Also, it may be difficult to connect and disconnect the washing machine hoses, when desired. Therefore, although such recessed boxes may appear to have some attractive aspects at the outset, they have some attendant disadvantages which are better recognized with the passage of time. Also, they do take considerable space within a wall and at the wall surface. In addition, the unit such as shown in the Hertenstein et al. Pat. No. 2,832,080 requires holes through the wall above the hole for the box, to receive the stems of the hot and cold water control valves. There has remained a need for a simple and inexpensive and convenient device to facilitate the connection of the water supply and drain lines of a building to a washing machine or lavatory.

SUMMARY OF THE INVENTION

Described briefly, according to a typical embodiment of the present invention, an in-the-wall base unit is provided for connection of building water supply and drain lines to it. A surface-mounted adaptor unit is fastened to the front of the base unit, extends outside the wall for connection of the supply and drain lines in the one instance to a washing machine, and in the other example, to a lavatory. A cover plate neatly frames the adaptor unit and covers the relatively small opening in the wall board through which it extends. A single lever valve assembly controls both the hot and cold water. Built-in drain and vent provisions are made.

DESCRIPTION OF THE PREFERRED EMBODIMENT

Figure 1:
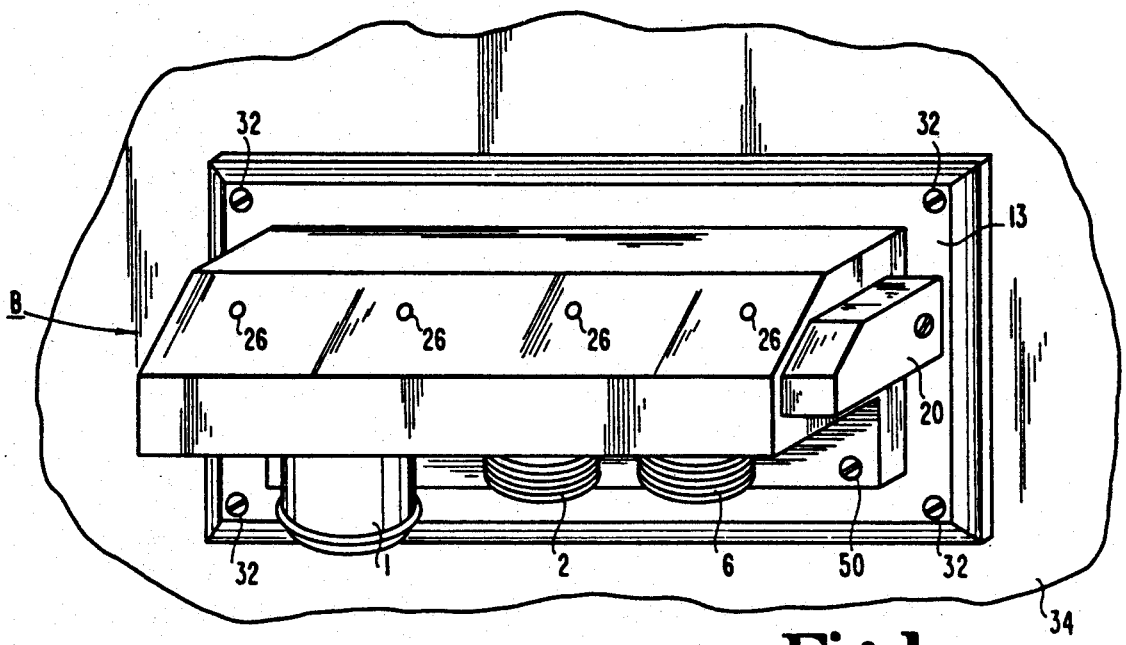
FIG. 1 is a pictorial view of the washing machine hook-up assembly according to my invention and as seen mounted to the wall surface.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
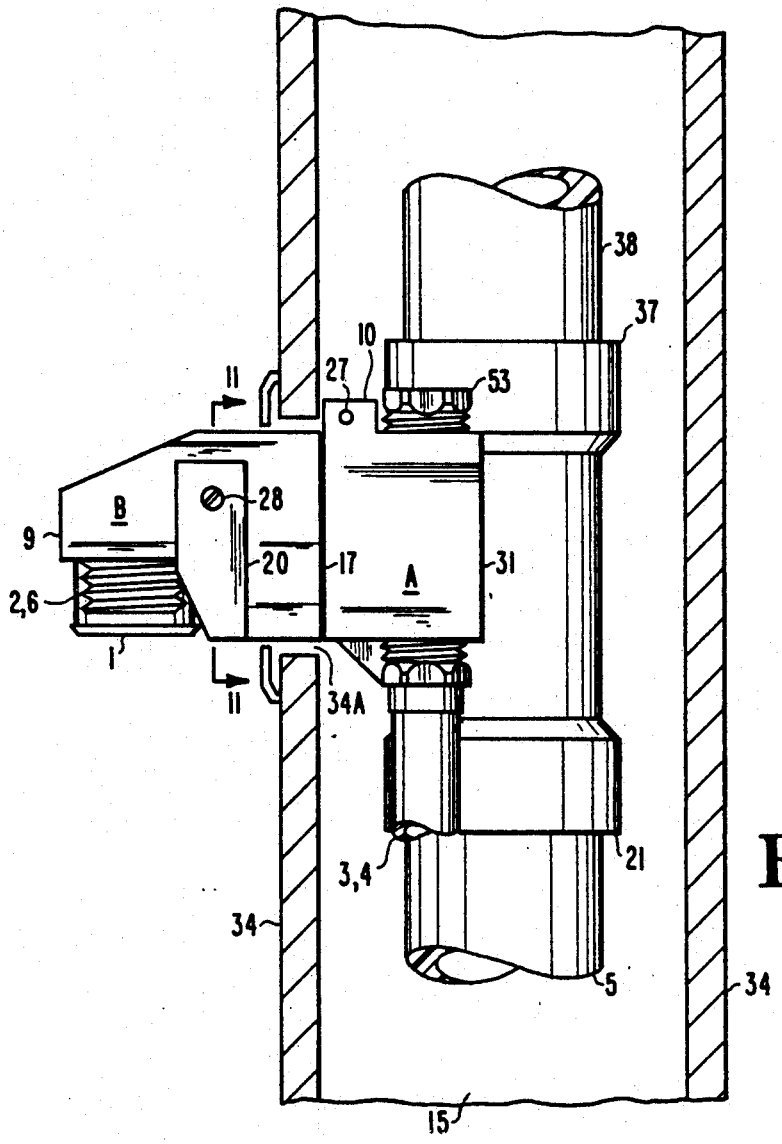
FIG. 2 is a vertical section through a portion of the building wall showing the washing machine hook-up assembly.
Figure 3:
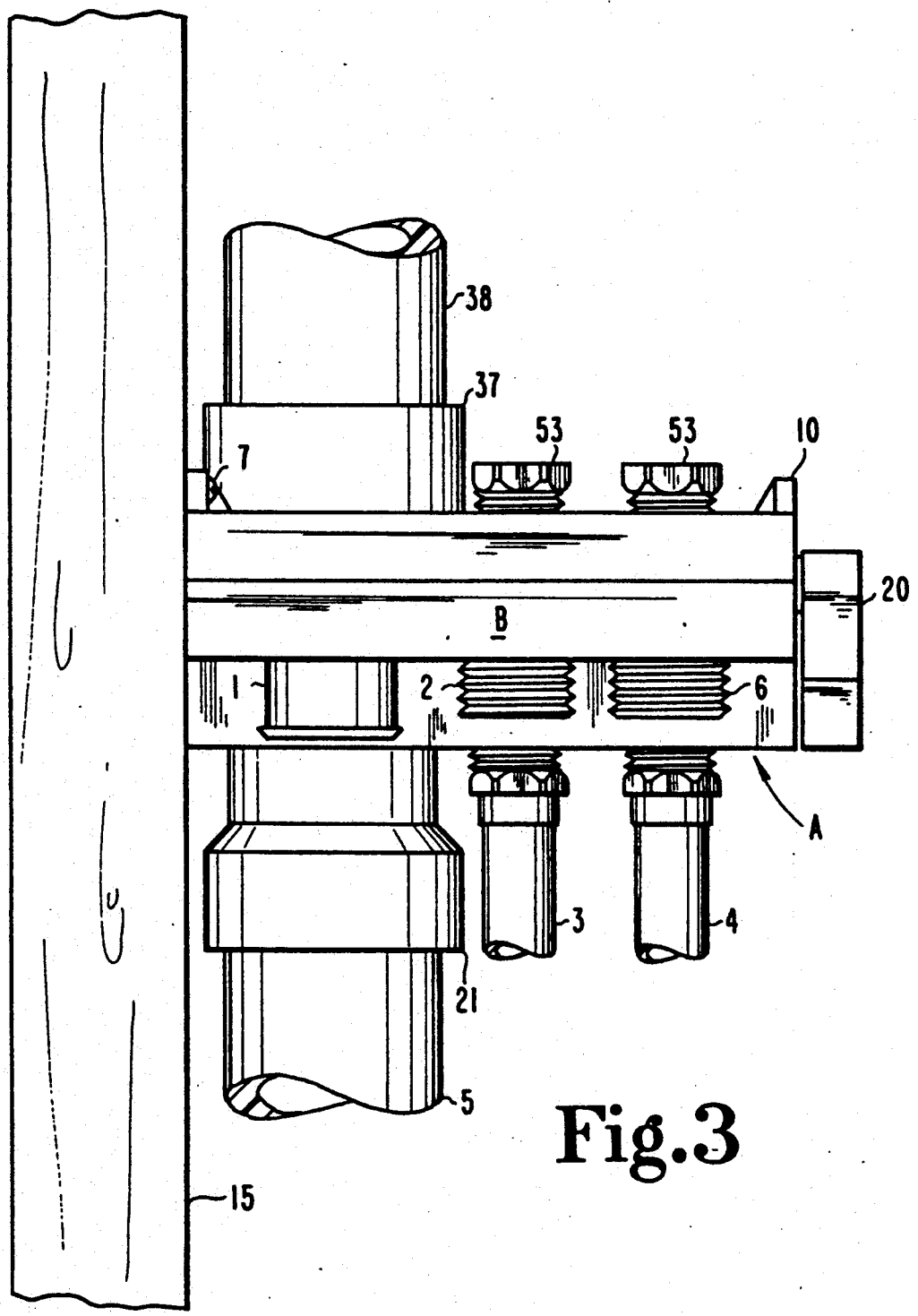
FIG. 3 is a front elevational view of the hook-up assembly mounted to a wall stud, but with the wall board omitted.
Figure 4:
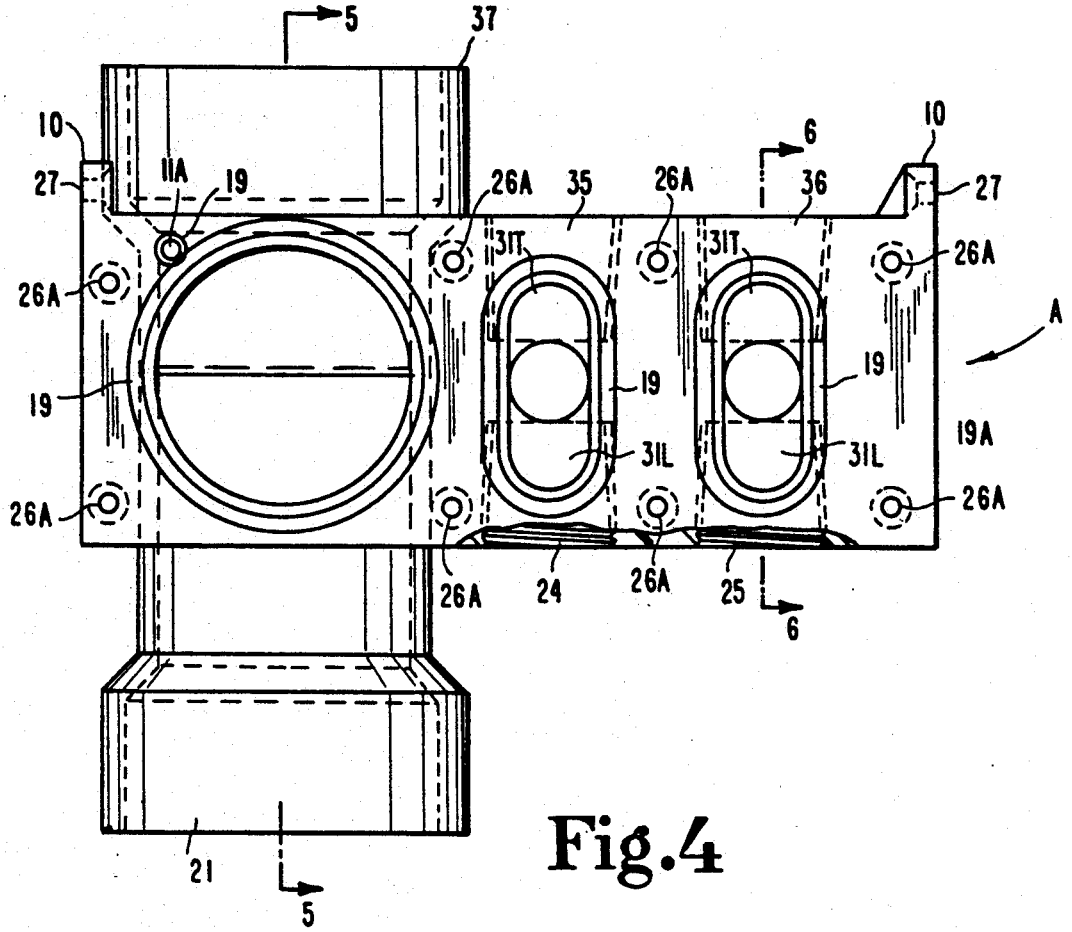
FIG. 4 is a front elevational view of the base unit itself.
Figure 6:
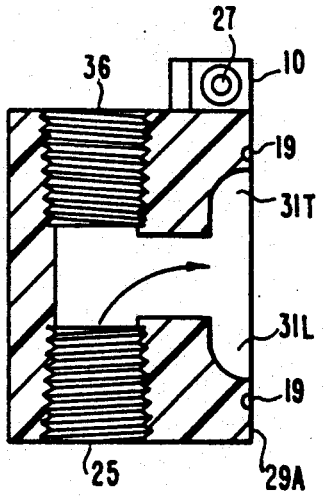
FIG. 6 is a section through the base unit taken at line 6—6 in FIG. 4 and viewed in the direction of the arrows.
Figure 5:
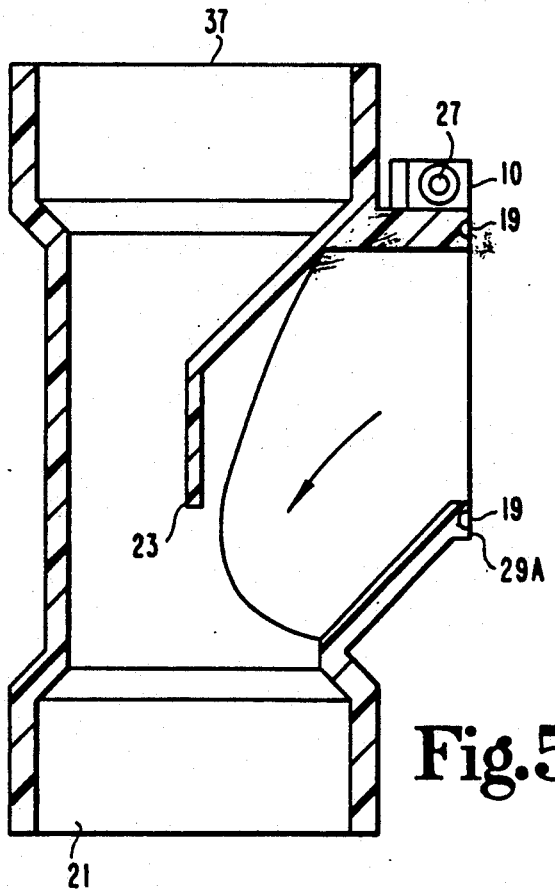
FIG. 5 is a section taken through the base unit at line 5—5 in FIG. 4 and viewed in the direction of the arrows.
Figure 7:
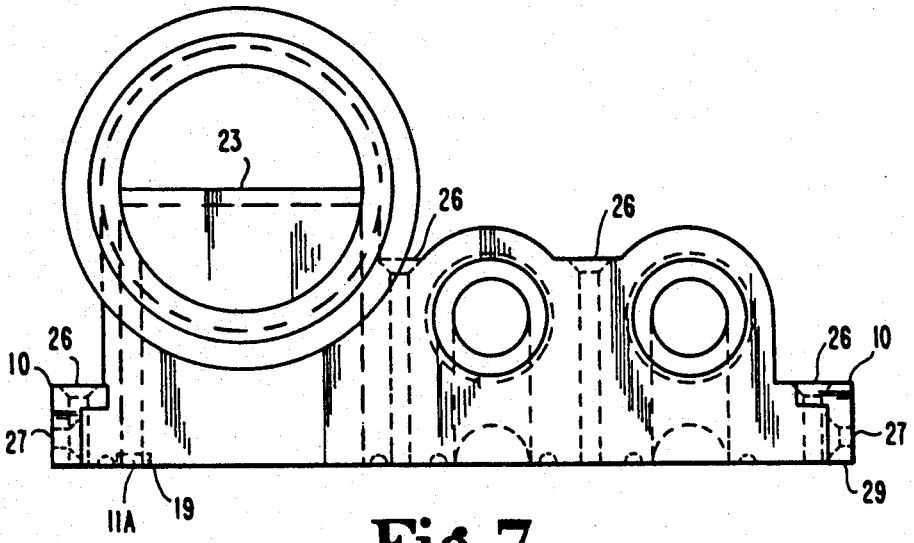
FIG. 7 is a top plan view of the base unit.
Figure 8:
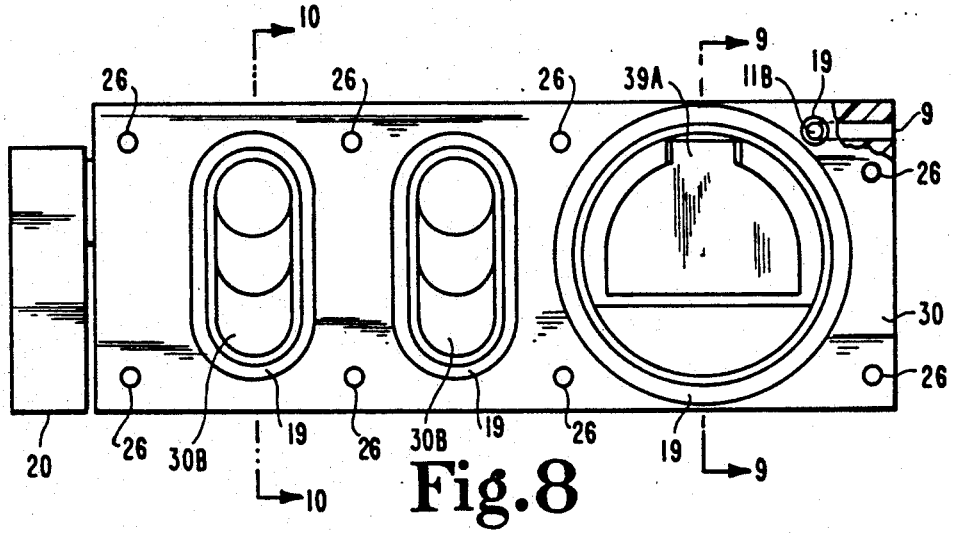
FIG. 8 is a rear view of the adaptor unit for the washing machine hook-up assembly.
Figure 9:
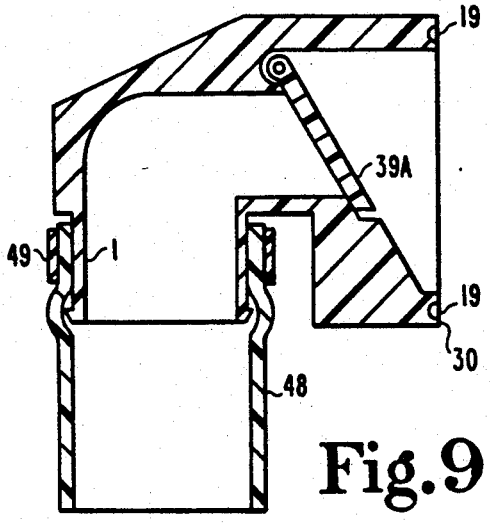
FIG. 9 is a section therethrough taken at line 9—9 in FIG. 8 and viewed in the direction of the arrows.
Figure 10:
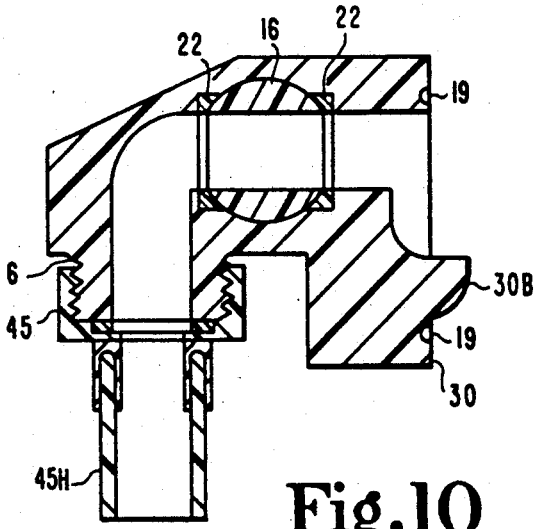
FIG. 10 is a section therethrough taken at line 10—10 in FIG. 8 and viewed in the direction of the arrows.
Figure 11:
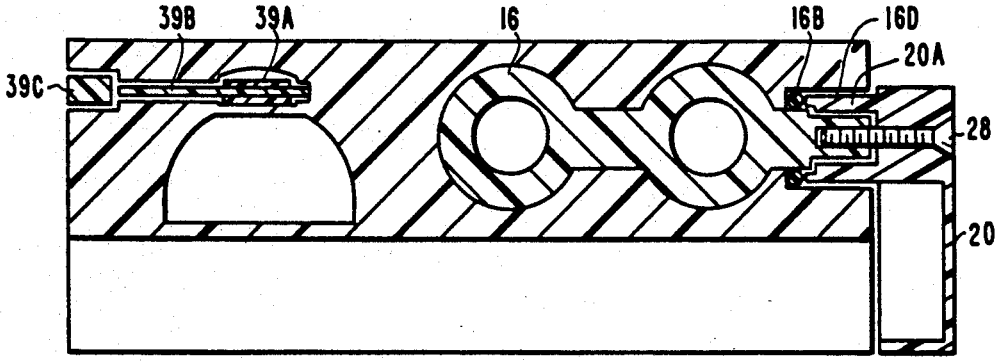
FIG. 11 is a vertical section therethrough taken at line 11—11 in FIG. 2 and viewed in the direction of the arrows.

Referring now to the drawings in detail, it will be observed that both embodiments of the present invention incorporate some of the same concepts and one major component. They both provide a system wherein the major component is mounted between the studs in a wall, and the adaptor extends through a small hole in the wall and has a provision for connecting the hot water and cold water hoses and the drain hose of the washing machine in the one embodiment, and the hot and cold water lines and the drain pipe for lavatory in the other embodiment. The base unit which is common to both embodiments is illustrated as component A in FIG. 2. The front and top views thereof are shown in FIGS. 4 and 7, respectively, while FIGS. 5 and 6 are vertical sections through it at the section lines shown in FIG. 4. The adaptor unit for the washing machine hook-up assembly is shown at B in FIGS. 1, 2 and 3, and the adaptor unit is shown in FIGS. 8–11. As shown in FIG. 3, where the base unit A is behind the adaptor unit B, there is a downwardly extending inlet pipe 1 having a perimetrical flange at the lower end thereof and to which the drain hose of a washing machine may be fastened and secured by a suitable hose clamp. There are also two downwardly extending, externally threaded hose bibs 2 and 6 to which the washing machine hot water and cold water supply hoses, respectively, may be mounted by the usual screw-on connection. There is also the hot water supply riser 3 and cold water supply riser 4 from the building, each having an externally threaded fitting with a hexagonal wrench-receiving surface thereon for mounting the risers to the downwardly opening internally threaded holes in the bottom of the base unit A. Also, there is the building drain stand pipe 5 fittingly received in the base unit drain fitting 21 to which it may be connected by suitable adhesive for plastic pipe connections. The base unit is connected to the building wall stud 15 by a mounting lug screw 7 extending through a mounting lug 10 integral with and projecting up from the body of the base unit at its left-hand end as shown in FIG. 3, and which has the hole 27 in it through which the screw 7 passes when it is secured to the stud 15. There is a similar lug 10 at the right-hand end of the base unit which also has a hole 27 through it so that the base unit can be mounted on the left-hand side of a stud on its right, if desired.

The front face 29 of the base unit has two virtually identical and somewhat oval-shaped openings therein, each of which has an O-ring groove 19 around it. It also has a relatively large circular opening with an O-ring groove 19 around it. The first two openings are for the hot and cold water from the risers 3 and 4, respectively, passing through the base unit to enter the adaptor unit B for the washing machine hook-up assembly, or the adaptor C for the lavatory hook-up adaptor assembly, as will be described later. As best shown in FIG. 2, where the stud 15 is shown between the drywall 34 at both faces of the wall, the adaptor B extends through the cut-out opening 34A in the left-hand sheet of drywall. This adaptor unit has eight body assembly screw holes 26 therein which are registrable with the counterpart but threaded holes 26A in the base. These receive body assembly screws 50 whereby the adaptor unit B is secured to the base unit A, with O-rings 17 (FIG. 2), received in the facing grooves around the hot water supply, cold water supply and drain openings in the respective faces 29A and 30 of the base unit and adaptor unit, respectively. After the adaptor plate has been adequately secured to the base plate by the eight screws 50, the cover plate 13 is mounted to the wall and secured by cover plate screws 32, two of which penetrate into the existing 2×4 stud 15, and two of which penetrate the drywall 34.

Referring specifically to FIGS. 8 through 11, some details of the adaptor unit for washing machine hook-up will be described. There is a dual ball and stem assembly 16 which is molded into the adaptor unit B with two seats 22 included in the assembly, as molded. These seats may be nylon or Delrin material. The stem is sealed by the O-ring 16B (FIG. 11) sealing against the stem and the wall of the hole 16D in unit B. This hole also receives the cylindrical sleeve portion 20A of the shut-off lever 20 which is received in the hole 16D and encircles the end of the stem, the lever being secured in place by the lever assembly screw 28 which is threaded into the end of the dual ball valve. The hole through each of the balls on this valve provides the communicating path from the base unit A through the adaptor unit B to the hot and cold water outlets 2 and 6, respectively. When the shut-off lever is turned 90° on its axis, the paths through the assembly unit are shut, to thereby close both the hot and cold water supply paths simultaneously.

In the drain passageway through the adaptor unit B, there is a check valve 39A shown blocking the passageway. This valve is pivotally mounted on a hinge pin 39B which is confined in an aperture in the adaptor unit B by the plug 39C.

In the operation of the washing machine hook-up assembly, hot and cold water, supplied by the hot water supply riser 3 and cold water supply riser 4 in the wall (FIGS. 2 and 3) enter the base unit A. The hot and cold water flows through the respective passageways, turning 90° to horizontal and then out the front face 29A of unit A. The water then enters the back face 30 of adaptor unit B, passes through the first valve seat 22, through the dual ball and stem assembly, and through the second seat 22 and then turns 90° downward and out the hot water supply outlet 2 and cold water supply outlet 6. The hot and cold water supply hoses connected to these bibs 2 and 6 deliver the water to the washing machine. These hose bibs have ¾ inch hose threads. On/off operations are accomplished by making a ¼ turn of the shut-off lever 20. With the lever pointing down, the water is turned on. With the lever horizontal as shown in FIG. 1, the water is turned off.

Discharged water from the washing machine exits the machine via the washer discharge hose 48 (FIG. 9) connected to the drain inlet 1 to which the hose is connected by the spring clamp 49. The discharged water passes up through the drain inlet 1, turns 90°, passes through the check valve assembly 39 and exits the back face 30 of part B. The discharge then passes through the front face 29A of base unit A, and is deflected downward by the splash plate 23 (FIG. 5 and exits down through the drain outlet 21 into the building drain stand pipe 5 which is within the wall. An air break 11 (FIG. 5) is created by a passageway which starts at an end of the adaptor unit at 9 (FIG. 8), extends inward and then rearward to the hole 11B which is in registry with the hole 11A in the base unit (FIG. 4) at the end of a hole which opens into the space above and behind the splash plate 23. Venting is accomplished by a building vent pipe 38 inside the wall connected to the main vent outlet 37 of the base unit A. As is true of the hot and cold water and drain passageway, the air break passageways are sealed by an O-ring in the grooves in the facing faces 29A and 30 of parts A and B when the parts are fastened together by the assembly screws 50.

Figure 12:
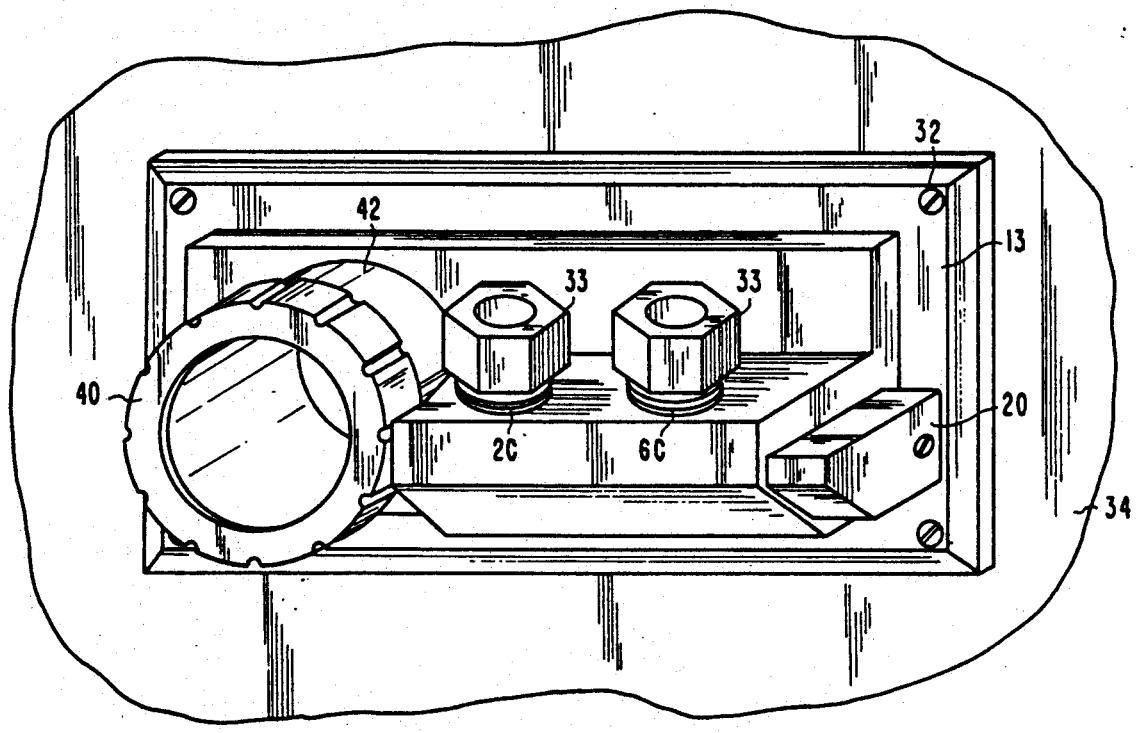
FIG. 12 is a frontal pictorial view of the lavatory hook-up assembly mounted to a wall (shown fragmentarily).
Figure 13:
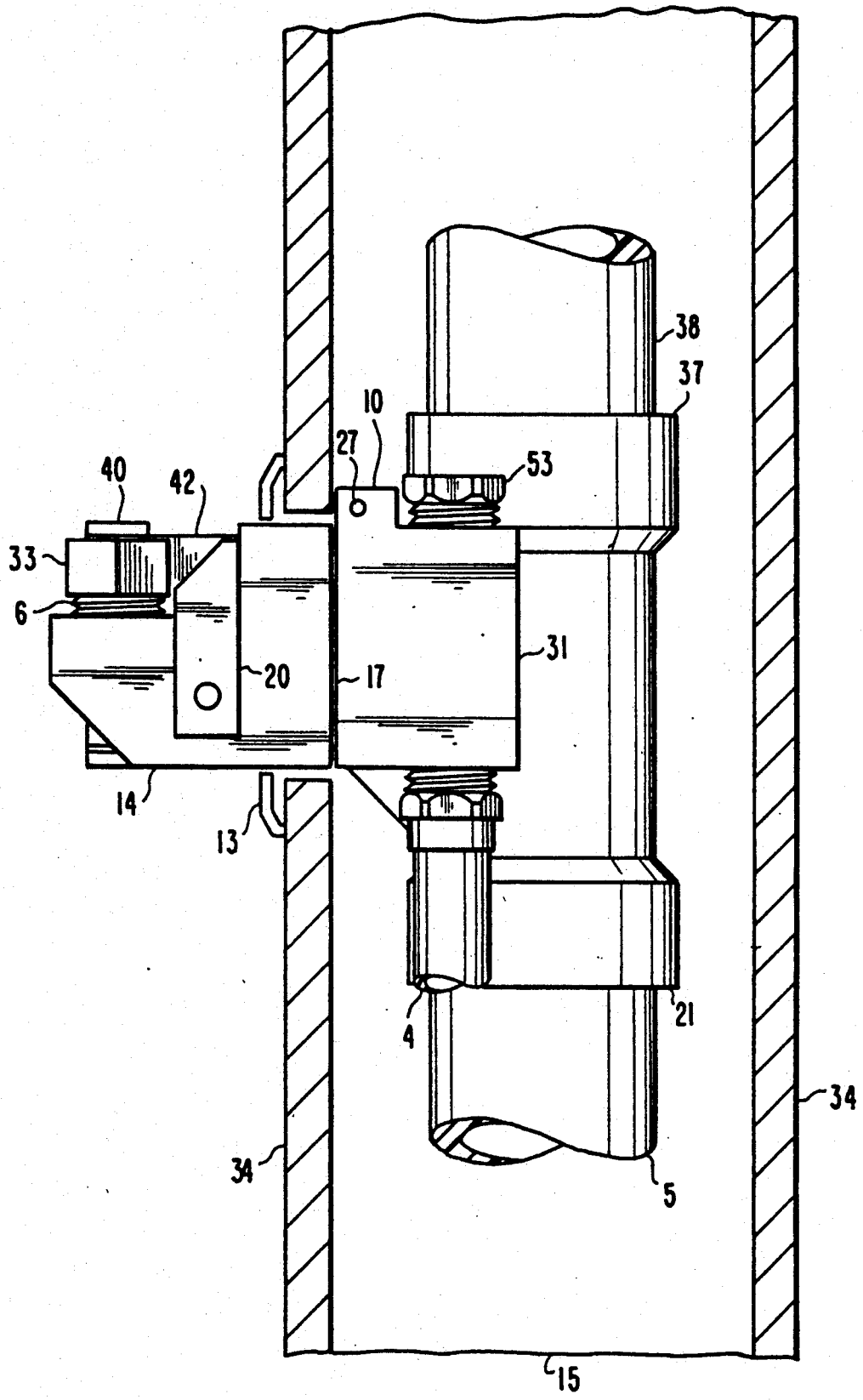
FIG. 13 is a vertical section through the wall showing the lavatory hook-up assembly installed.
Figure 17:
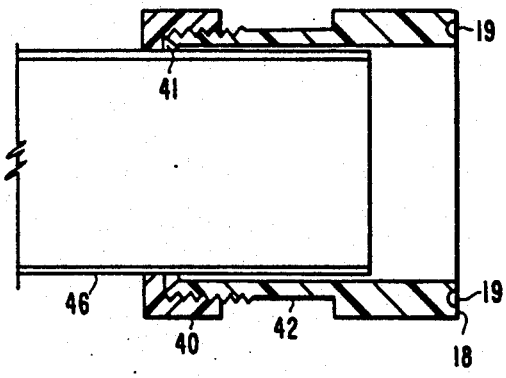
FIG. 17 is a section therethrough taken at line 17—17 in FIG. 16 and viewed in the direction of the arrows.
Figure 18:
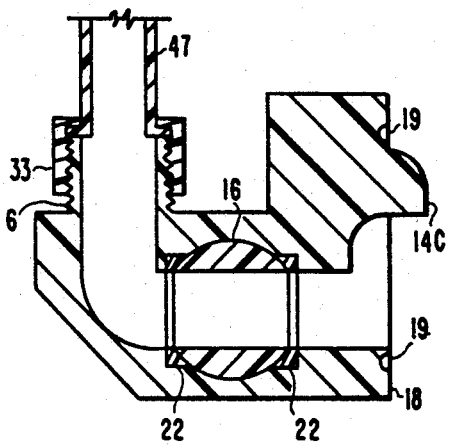
FIG. 18 is a section therethrough taken at line 18—18 in FIG. 16 and viewed in the direction of the arrows.
Figure 16:
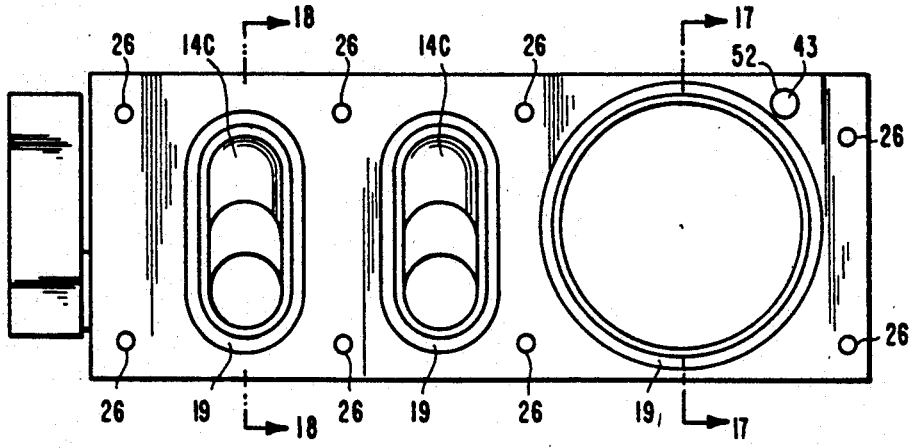
FIG. 16 is a rear view thereof.

Now that the washing machine hook-up assembly has been described, the lavatory hook-up assembly will be described with reference to FIGS. 12–19. The base unit, installation features, and cover plate 13 are the same as described with reference to the washing machine hook-up assembly. But the adaptor unit C is different in some respects. The rear face of it as shown in FIG. 17 is almost identical to that of the adaptor unit B for the washing machine hook-up assembly, since it mounts to the base unit and communicates with the base unit in the same way. However, whereas the flow guiding bosses 30B (FIGS. 8 and 10) enter the mating cavity at 31L (FIGS. 4 and 6) at the bottom of the water supply port in the face 29A of the base unit in the washing machine hook-up assembly, the flow guiding bosses 14C (FIGS. 16 and 18) enter the top 31T (FIGS. 4 and 6) of the cavity in the base unit above the water supply port. Thus, the lower surfaces of these bosses turn the water downward for passage through the dual ball valve and stem assembly 16 which is constructed in the same way as described above with reference to the washing machine hook-up assembly. The outlets from the dual ball and stem assembly valves turn upward to the externally threaded connector bosses 2C and 6C for the hot and cold water, respectively. Flexible riser tubes 47 (FIG. 18) may be connected to these outlets by flared or compression fittings secured by compression nuts 33 (FIGS. 12 and 18).

A waste connection 42 is also provided on the adaptor unit C and is connected to the end portion 46 of a conventional P-trap for a lavatory, with the compression gasket 41 and nut 40 (FIG. 17) providing the necessary seal at that location.

In the lavatory hook-up assembly, the hot and cold water, supplied by the risers 3 and 4, respectively, pass through the base unit A in the same way as described above with reference to the washing machine assembly. The water is turned downward by the guide bosses 14C at the back face 18 of unit C and then passes through the first and second valve seats for each of the two balls of the dual ball valve and then turns 90° upward and out the outlets 2C and 6C. The flexible riser tubes 47 (FIG. 18) deliver the water to the lavatory faucets. On-off operation for the supply to the faucets is achieved by turning the shut-off lever 20 a quarter turn between the positions shown in the figures.

Waste water leaving the sink via an existing P-trap and pipe 46 enters the waste connection 42 and exits the back face 18 of adaptor unit C and enters the front face of the base unit A where it is deflected downward by the splash plate 23 and exits down the drain outlet 21. Venting is accomplished by the vent pipe 38 as described above. Although an air break was described with reference to the washing machine hook-up assembly, it is not necessary for hook-ups to lavatories, so the corresponding hole in the base unit is sealed by an air break seal plug 43 (FIG. 16) mounted in the air break plug recess 52 and which is placed in that recess before the assembly of adaptor unit C to base unit A. The shut-off lever 20 is mounted to the stem the same way by placing the stem packing ring 12 around the stem end of the dual ball and stem assembly, then mounting the shut-off lever in place and securing it by inserting the lever assembly screw 28 through the lever screw hole 51 and tightening.

Figure 14:
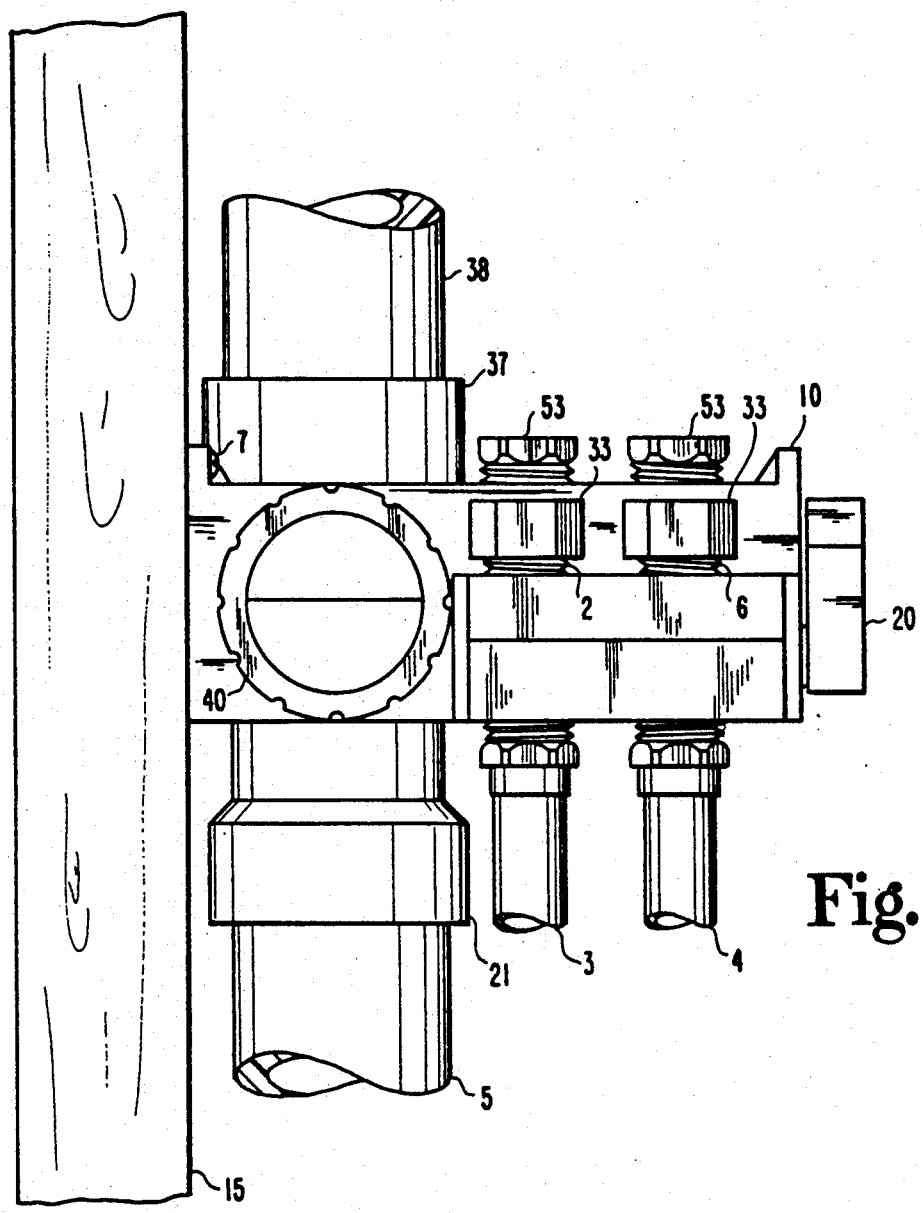
FIG. 14 is a front elevational view thereof mounted to a wall stud, but with the wall board omitted.
Figure 15:
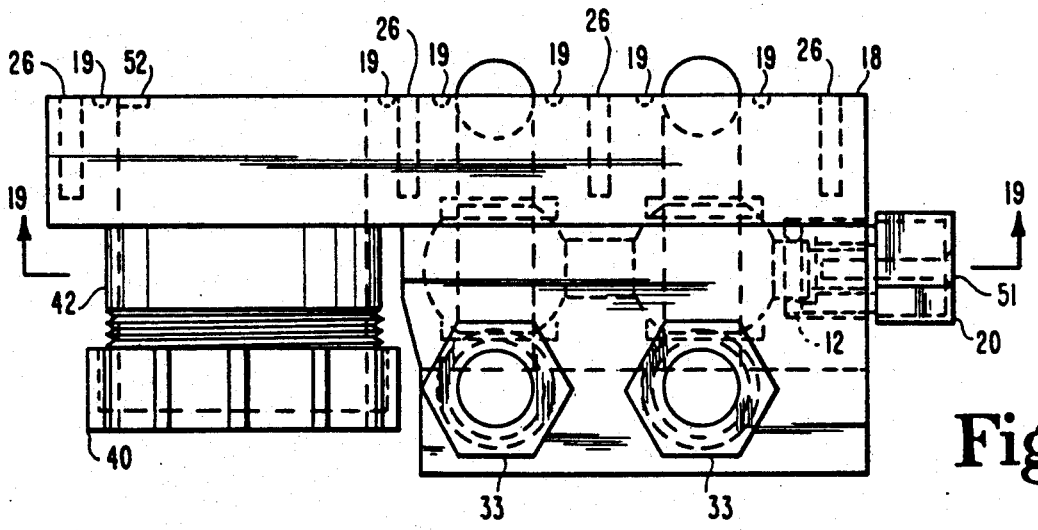
FIG. 15 is a top plan view of the adaptor unit for the lavatory hook-up assembly.
Figure 19:
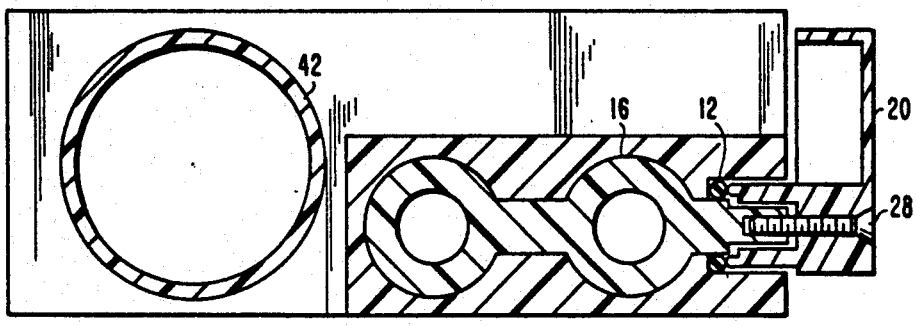
FIG. 19 is a section therethrough taken at line 19—19 in FIG. 15 and viewed in the direction of the arrows.

Referring back to FIG. 6, the internal threads 25 and 36 are directly in vertical alignment. The threads 25 are used to receive the cold water riser connector, and corresponding threads 24 (FIG. 4) are used to receive the hot water riser connector. The threads 36 and their counterpart aligned with threads 24 above the hot water riser are provided if the unit is to be supplied from above. Otherwise, they are plugged by the plugs 53 (FIGS. 3 and 14). When the supply is from above, the plugs 53 are employed in the holes 24 and 25.

Also as may be evident to those skilled in the art, the dual ball valve is intended to be molded in place. In other words, the dual ball and stem itself is to be premanufactured, and then placed in a suitable mold with the attendant seals 22 properly positioned, the passageway therethrough being properly cored, and then the adaptor unit B or C, as the case may be, molded in place around it. The stem seal 12, operating handle 20, are installed later, as described above.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The invention claimed is:

1. A water supply hookup assembly comprising:

a base unit comprising a block of material having inlet fittings for connection of cold and hot water supply to them, and the block having fan outlet face with cold and hot water outlet ports in the face;

an adaptor unit having an inlet face with cold and hot water inlet ports thereon, and said adaptor unit having cold and hot water delivery fittings thereon;

said base unit having means thereon for mounting between studs in a building wall with the outlet face thereof facing a room at one side of the wall;

said adaptor unit being mounted to the base unit with the outlet ports of the base unit in registry with the inlet ports of the adaptor unit to provide a passageway for the cold water from the cold water inlet fitting of the base unit to the cold water delivery fitting of the adaptor unit and to provide a passageway from the hot water inlet fitting of the base unit to the hot water delivery fitting of the adaptor unit.

2. The assembly of claim 1 and further comprising:

a valve in each of said cold and hot water passageways in said adaptor unit.

3. The assembly of claim 2 and wherein:

said valves are ball valves and are operable simultaneously to open or close said cold and hot water passageways.

4. A water supply hookup assembly comprising:

a base unit having inlet fittings for connection of cold and hot water supply to them, and having an outlet face with cold and hot water outlet ports;

an adaptor unit having an inlet face with cold and hot water inlet ports thereon, and said adaptor unit having cold and hot water delivery fittings thereon;

said base unit having means thereon for mounting between studs in a building wall with the outlet face thereof facing a room at one side of the wall;

said adaptor unit being mounted to the base unit with the outlet ports of the base unit in registry with the inlet ports of the adaptor unit to provide a passageway for the cold water from the cold water inlet fitting of the base unit to the cold water delivery fitting of the adaptor unit and to provide a passageway from the hot water inlet fitting of the base unit to the hot water delivery fitting of the adaptor unit;

a waste water inlet fitting on the adaptor unit and a waste water delivery port on the inlet face of the adaptor unit;

a waste water inlet port on the outlet face of the base unit and a waste water discharge fitting on the base unit; and a waste water passageway from the waste water inlet fitting of the adaptor unit to the waste water discharge fitting of the base unit.

5. The assembly of claim 4 and further comprising:

a check valve in the waste water passageway in the adaptor unit and oriented to prevent flow through said waste water passageway toward the waste water inlet fitting of the adaptor unit.

6. The assembly of claim 4 and further comprising:

a vent fitting on the base unit associated with said waste water passageway for connection to a sewer vent pipe in a building.

7. The assembly of claim 6 and further comprising:

an air break passageway having an inlet in a wall of said adaptor unit and extending to said inlet face of said adaptor unit and extending into said wastewater passageway in said base unit and exiting in the base unit to communicate with the interior of the vent fitting.

8. The assembly of claim 6 and further comprising:

a waste deflector wall in the waste water passageway in the base unit and below the vent fitting and oriented to turn the flowing waste water downward toward said waste discharge fitting of the base unit.

9. In combination with a wall of a building, said wall having a finished wall surface member and a wall stud on one side of the member and a room in the building on the other side of the member and in which a water receiving and waste delivering device is located, the improvement comprising:

a base unit on one side of the member and having inlet fittings for connection of cold and hot water supply to them, and having an outlet face with cold and hot water outlet ports;

an adaptor unit in the room and having an inlet face with cold and hot water inlet ports thereon, and said adaptor unit having cold and hot water delivery fittings thereon;

said base unit having means thereon connecting the base unit to the stud in the building wall with the outlet face of the base unit facing the room;

said adaptor unit being mounted to the base unit with the outlet ports of the base unit in registry with the inlet ports of the adaptor unit to provide a passageway for the cold water from the cold water inlet fitting of the base unit to the cold water delivery fitting of the adaptor unit and to provide a passageway from the hot water inlet fitting of the base unit to the hot water delivery fitting of the adaptor unit;

a waste water inlet fitting on the adaptor unit and a waster water delivery port on the inlet face of the adaptor unit;

a waste water inlet port on the outlet face of the base unit and a waste water discharge fitting on the base unit; and a waste water passageway from the waste water inlet fitting of the adaptor unit to the waste water discharge fitting of the base unit;

a sewer drain line on the one side of the wall member;

the waste water inlet fitting being in the room, and the waste water discharge fitting being on the one side of the wall and connected to said drain line.

10. The improvement of claim 9 and further comprising:

a check valve in the waste water passageway in the adaptor unit and oriented to prevent flow through said waste water passageway toward the waste water inlet fitting of the adaptor unit.

11. The improvement of claim 9 and further comprising:

a sewer gas vent line on the one side of the wall member for venting sewer gas to the outside of the building; and a vent fitting on the base unit associated with said waste water passageway and connected to said vent line in the building.

12. The improvement of claim 11 and further comprising:

an air break passageway having an inlet in a wall of said adaptor unit and extending to said inlet face of said adaptor unit and extending into said wastewater passageway in said base unit and exiting in the base unit to communicate with the interior of the vent fitting.

13. The improvement of claim 11 and further comprising:

a waste deflector wall in the waste water passageway in the base unit and below the vent fitting and oriented to turn the flowing waste water downward toward said waste discharge fitting of the base unit.

* * * * *